US009476344B2

(12) United States Patent
Clement et al.

(10) Patent No.: US 9,476,344 B2
(45) Date of Patent: Oct. 25, 2016

(54) COMPACT COOLING DEVICE FOR AN INTERNAL COMBUSTION ENGINE AND METHOD FOR MANUFACTURING SUCH A DEVICE

(71) Applicant: Bontaz Centre R&D, Marnaz (FR)

(72) Inventors: Denis Clement, Mieussy (FR); Stéphane Perotto, Ayse (FR)

(73) Assignee: BONTAZ CENTRE R&D, Marnaz (FR)

( * ) Notice: Subject to any disclaimer, the term of this patent is extended or adjusted under 35 U.S.C. 154(b) by 0 days.

(21) Appl. No.: 14/247,354

(22) Filed: Apr. 8, 2014

(65) Prior Publication Data

US 2014/0305392 A1 Oct. 16, 2014

(30) Foreign Application Priority Data

Apr. 11, 2013 (FR) ..... 13 53293

(51) Int. Cl.

| | |
|---|---|
| ***F01P 3/06*** | (2006.01) |
| ***F01P 3/08*** | (2006.01) |
| ***F01M 1/08*** | (2006.01) |
| *F01M 1/16* | (2006.01) |

(52) U.S. Cl.

CPC . *F01P 3/06* (2013.01); *F01M 1/08* (2013.01); *F01P 3/08* (2013.01); *F01M 1/16* (2013.01); *F01M 2001/083* (2013.01); *Y10T 29/49249* (2015.01)

(58) Field of Classification Search

CPC ..... F01P 3/08; F01P 3/06; F01P 11/04; F01P 2060/04; F01M 1/08

USPC ..... 123/41.35, 41.34, 41.73

See application file for complete search history.

(56) References Cited

U.S. PATENT DOCUMENTS

| | | | | |
|---|---|---|---|---|
| 4,206,726 A | | 6/1980 | Johnson, Jr. | |
| 4,667,630 A | * | 5/1987 | Sasaki | F01P 3/08 123/254 |
| 6,895,905 B2 | * | 5/2005 | Bontaz | F01P 3/08 123/41.35 |

(Continued)

FOREIGN PATENT DOCUMENTS

| | | |
|---|---|---|
| DE | 1216014 B | 5/1966 |
| EP | 1394376 A1 | 3/2004 |

(Continued)

OTHER PUBLICATIONS

Preliminary Search Report for FR-1353293 dated Jun. 28, 2013.

(Continued)

*Primary Examiner* — Lindsay Low
*Assistant Examiner* — Long T Tran
(74) *Attorney, Agent, or Firm* — Pearne & Gordon LLP

(57) ABSTRACT

A cooling device for a motor vehicle engine connected to a cooling fluid feed system, where the cooling device includes two superposed subassemblies, where the first subassembly includes a feed body connected to the feed aperture and a tube connected to the feed body, the free end of which forms a first evacuation end, where the tube extends laterally relative to the feed body and is shaped so as to have a desired orientation, where the second subassembly includes a feed body connected to the feed aperture and a tube connected to the feed body the free end of which forms the second evacuation end, where the tube extends laterally relative to the feed body and is shaped so as to have a desired orientation, and where the feed bodies are securely attached to one another in sealed fashion.

20 Claims, 6 Drawing Sheets

(56) References Cited

U.S. PATENT DOCUMENTS

Figure 1:
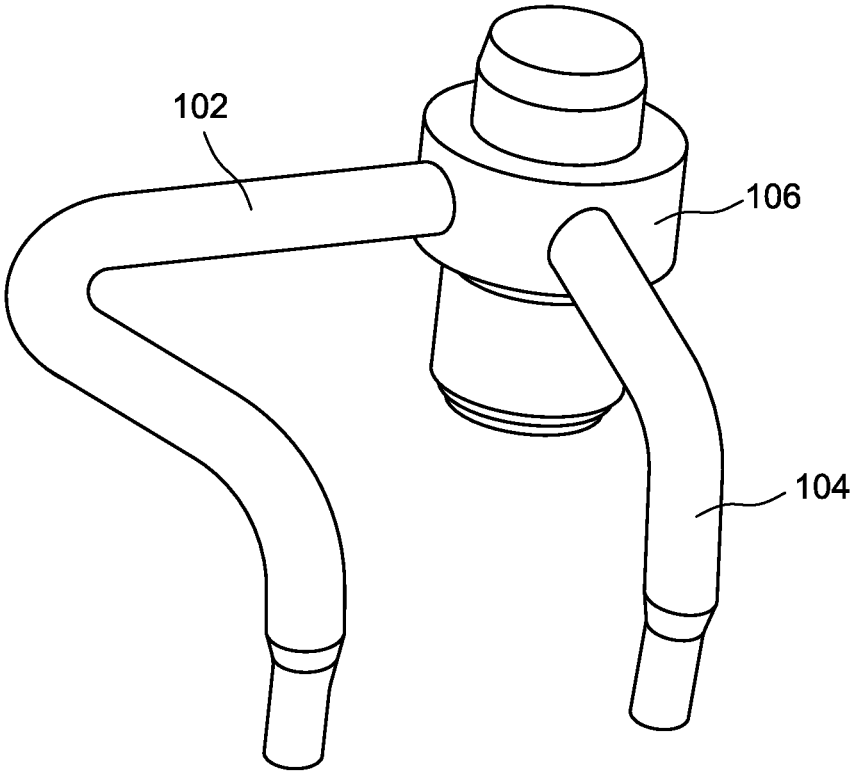
FIG. 1 PRIOR ART

| | | | | |
|---|---|---|---|---|
| 7,360,510 | B2 * | 4/2008 | Bontaz | F01P 3/08 123/41.35 |
| 8,307,791 | B2 * | 11/2012 | Sugiura | F01P 3/02 123/41.32 |
| 2004/0035371 | A1 * | 2/2004 | Tsengas | 119/710 |
| 2004/0035374 | A1 * | 2/2004 | Svensson | F01P 3/08 123/41.35 |
| 2004/0040520 | A1 * | 3/2004 | Bontaz | F01P 3/08 123/41.35 |
| 2005/0081802 | A1 * | 4/2005 | Bontaz | F01P 11/04 123/41.35 |
| 2005/0098122 | A1 | 5/2005 | Bontaz | |
| 2006/0243226 | A1 | 11/2006 | Bontaz | |
| 2008/0223318 | A1 | 9/2008 | Perotto | |
| 2010/0001103 | A1 * | 1/2010 | Neto | F01M 1/08 239/583 |
| 2013/0152883 | A1 | 6/2013 | Perotto | |
| 2014/0264101 | A1 | 9/2014 | Perotto | |

FOREIGN PATENT DOCUMENTS

| | | | | |
|---|---|---|---|---|
| EP | 1 529 935 | A1 | | 5/2005 |
| EP | 1 728 981 | A2 | | 12/2006 |
| EP | 1 980 729 | A1 | | 10/2008 |
| FR | 479630 | A | | 4/1916 |
| GB | 136136 | A | | 3/1920 |
| GB | 2431219 | B | * | 9/2011 |
| JP | 07243313 | A | * | 9/1995 |
| JP | H07 317519 | A | | 12/1995 |
| KR | 2008058739 | A | * | 6/2008 |

OTHER PUBLICATIONS

Office Action issued in European Patent Application No. 14 163 806.4 dated Nov. 12, 2015.

Anonymous, "need to find double banjo bolts" Norton Bulletin Board, BritBike Forum, Aug. 29, 2011.

* cited by examiner

COMPACT COOLING DEVICE FOR AN INTERNAL COMBUSTION ENGINE AND METHOD FOR MANUFACTURING SUCH A DEVICE

TECHNICAL FIELD AND PRIOR ART

The present invention relates to a compact cooling device for an internal combustion engine and to a method for manufacturing such a cooling device.

A spray nozzle for cooling a piston of an internal combustion engine enables a cooling fluid such as oil to be projected on to an appropriate area of the piston.

Piston cooling spray nozzles are habitually formed by separate parts attached to the engine block are linked to a cooling fluid inlet aperture. The spray nozzle's position is determined accurately to produce a cooling fluid jet directed towards a precise area of the base of the piston, or towards an inlet of a piston oil channel. In motor vehicles of the recreational vehicle type and private passenger vehicle type the internal combustion engines are fitted with simple spray nozzles, each of which directs a fluid jet on to a piston.

However it is desirable, in order to increase the cooling efficiency, to have several cooling fluid jets with identical or different target areas.

In the field of heavy goods vehicles or site plant the engines are subject to particularly high stress and require a more powerful cooling system. Such a cooling system represented in FIG. 1 may comprise two spray nozzles for each piston; each of these spray nozzles is formed by a tube 102, 104 connected to a feed body 106, where both tubes 102, 104 are positioned roughly one next to the other in the same plane, and the free end is pointing towards the area for cooling. These spray nozzles with two jets comprising two tubes 102, 104 are relatively bulky and, although they can be used in vehicles of the heavy goods or site plant type, they cannot be used in motor vehicles of the "recreational" type or in private cars, where the lateral space giving the tubes access in the piston skirt is small.

To make cooling system able to provide two jets per piston more compact bidirectional spray nozzles have been developed, where the spray nozzle comprises a single tube and two outlets to provide two jets pointing in different directions.

Such a spray nozzle is described in document EP 1 394 376. Indeed, this spray nozzle is compact, and suitable for a recreational motor vehicle and private motor vehicle; however it has a smaller flow rate compared to the cooling system with two separate tubes, and the accuracy of the jets may be less satisfactory than that of a cooling system with two separate tubes.

Document JP H07 317519 describes a device for lubricating and cooling an internal combustion engine comprising a main body on which an assembly with two pipes is assembled, where the pipes are in fluid communication with the main body. The two tubes are manufactured such that they are coupled securely to one another, and cannot be shaped separately.

DESCRIPTION OF THE INVENTION

One aim of the present invention is consequently to provide a cooling device allowing improved cooling, whilst being more compact and having jets with satisfactory target accuracy, and which provides a simplified method of manufacture of such a cooling device.

The aim mentioned above is attained by a cooling device comprising two superposed separate tubes; by this means the cooling device is made more compact. Each tube also forms with a feed body a subassembly which is manufactured separately from the other subassembly, the tubes being orientated before the two subassemblies are attached to one another. The tubes are then directly correctly orientated, and do not require an orientation step, for example by bending the tubes after assembly. By this means an additional step of bending the tubes is avoided, which would require equipment to be installed between the close tubes, which would pose problems of feasibility.

The cooling device according to the present invention is therefore relatively simple to produce, and compact, and has satisfactory accuracy in terms of the cooling jets, and a cooling flow rate comparable to the device of the state of the art, with two separate tubes.

It may be envisaged to use this cooling device with at least two cooling tubes, with one or two pistons.

The cooling device may comprise more than two separate tubes, where the cooling tubes are then added in a very simple manner, for example by superposing another subassembly consisting of a tube and a feed body.

The subject-matter of the present invention is then a cooling device for a motor vehicle engine comprising an end for connection to a cooling fluid feed system and at least one first end and one second end for evacuating cooling fluid towards one or more areas for cooling, where said cooling device comprises at least one first and one second superposed subassembly, where the first subassembly comprises a first feed body connected to the feed aperture, and a first tube connected to the first feed body the free end of which forms the first evacuation end, where the first tube extends laterally relative to the first feed body, and is shaped so as to have a desired orientation, where the second subassembly comprises a second feed body connected to the feed aperture, and a second tube connected to the second feed body the free end of which forms the second evacuation end, where the second tube extends laterally relative to the second feed body, and is shaped so as to have a desired orientation, and where the first and second feed bodies are securely attached to one another in sealed fashion.

The first and second subassemblies are, for example, securely attached by brazing. Alternatively, the first and second subassemblies are securely attached by means of a valved-bolt assembly.

The first feed body may comprise the feed aperture of the cooling device and the second subassembly may be intended to be supplied with cooling fluid through the first feed body.

In one example embodiment each first and second subassembly comprises two tubes.

According to an additional characteristic the device may comprise means to control the flow of the cooling fluid.

The cooling device preferably comprises means for attachment to an engine block. In one example embodiment the means of attachment to an engine block are formed by a securing plate attached to a first feed body which can be attached to the engine block. In another example embodiment the valved-bolt assembly also forms the means of attachment to the engine block.

The device may advantageously comprise means of orientation relative to the engine block. The orientation means are, for example, supported directly by the first feed body or by a plate which is securely attached to the first feed body. The orientation means may be formed by a pin intended to penetrate into an aperture formed in the engine block.

Another subject-matter of the present invention is an internal combustion engine comprising an engine block and pistons installed such that they can slide in said engine block, and at least one cooling device according to the invention, where at least one of the tubes of said cooling device is pointing towards a piston.

Another subject-matter of the present invention is a method for the manufacture of a cooling device according to the invention, comprising the following steps:

a) construction of a first subassembly comprising a first feed body fitted with a feed aperture intended to be connected to a cooling fluid feed system, and at least one first tube, where said first tube is connected to the first feed body, b) construction of a second subassembly comprising a second feed body comprising a feed aperture intended to be connected to a cooling fluid feed system, and at least one second tube connected to the second feed body, c) shaping of the first tube so as to give it a given orientation, d) shaping of the second tube so as to give it a given orientation, e) assembly and secure attachment of the two subassemblies.

In a preferred manner, the first tube and the second tube are shaped so as to give them a given orientation before the two subassemblies are assembled.

The shaping of the first tube and of the second tube is accomplished for example by bending.

The step of secure attachment of the first and second subassemblies may be accomplished by brazing between the feed bodies.

As a variant, the step of secure attachment of the first and second subassemblies is accomplished by means of a valved-bolt assembly.

The manufacturing method may comprise an additional step of shaping of the free end of at least one of the first and second tubes after step e).

BRIEF DESCRIPTION OF THE ILLUSTRATIONS

Figure 2:
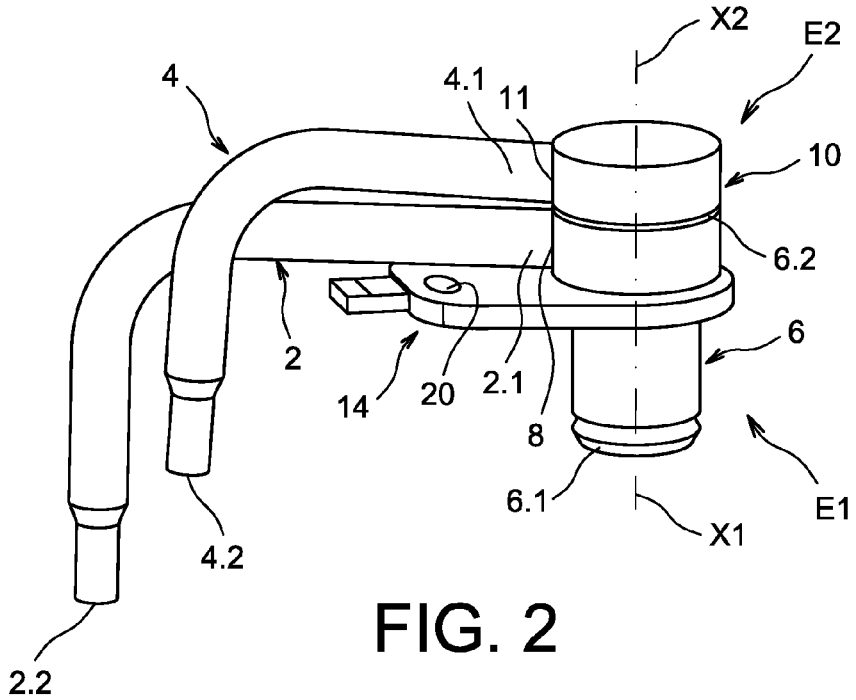
Figure 3:
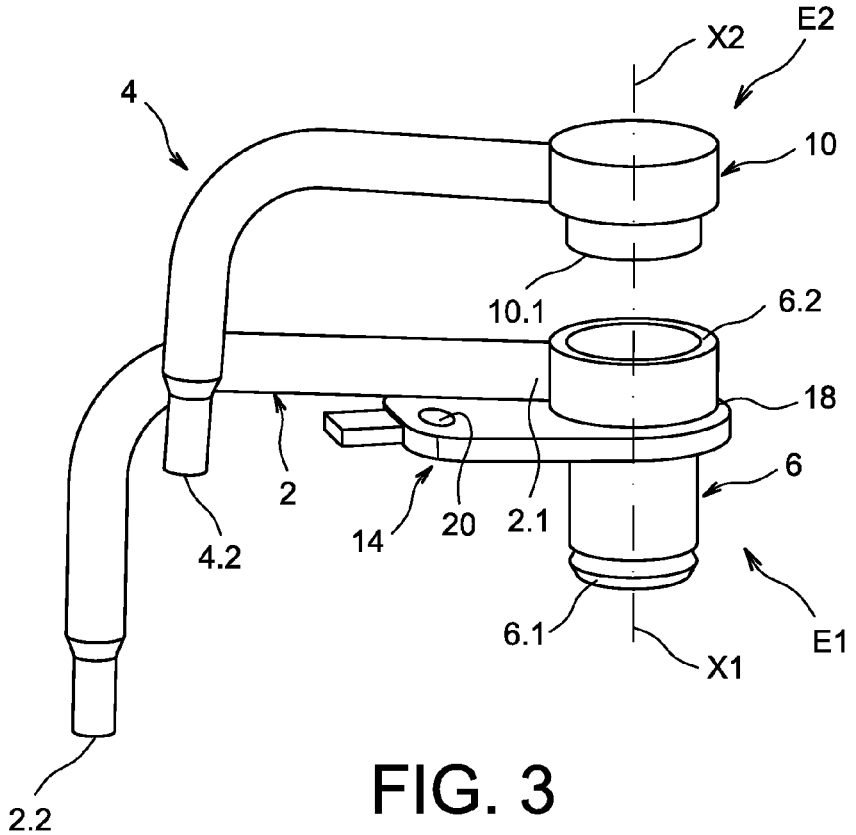
Figure 4:
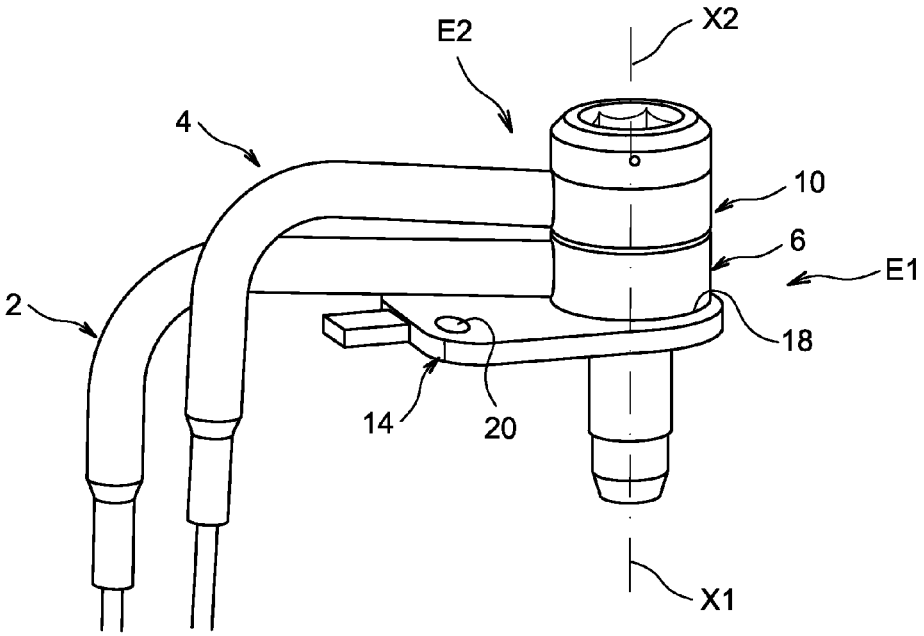
Figure 5:
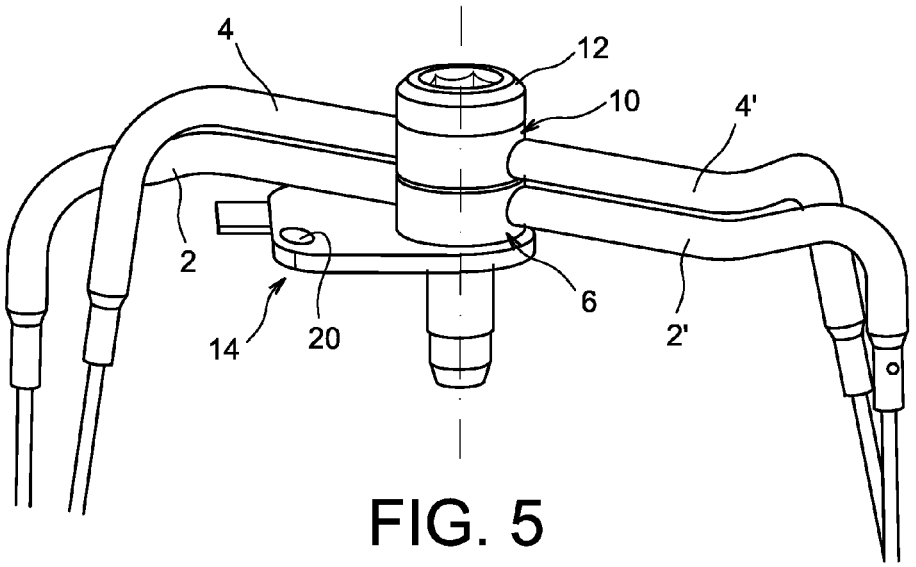
Figure 6:
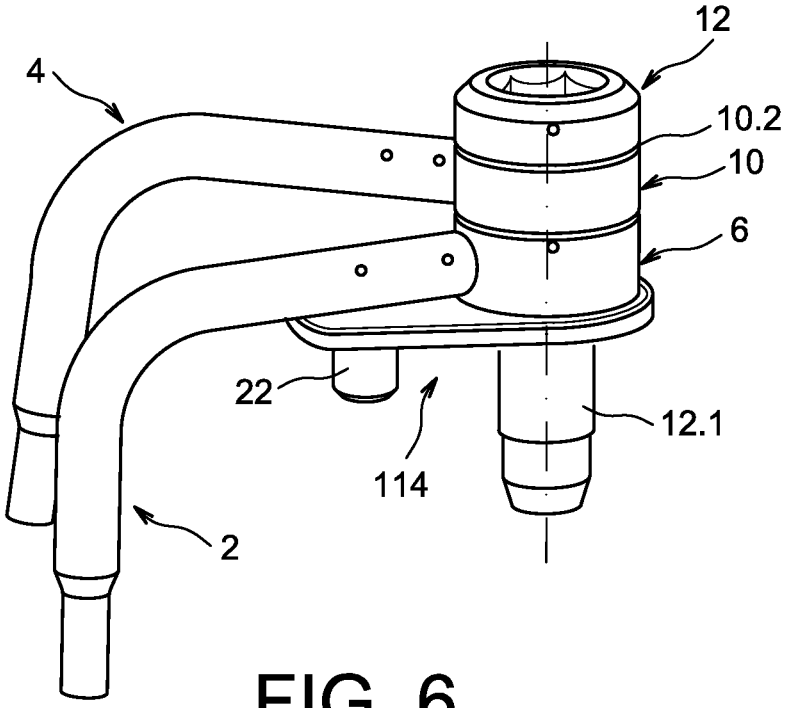
Figure 7:
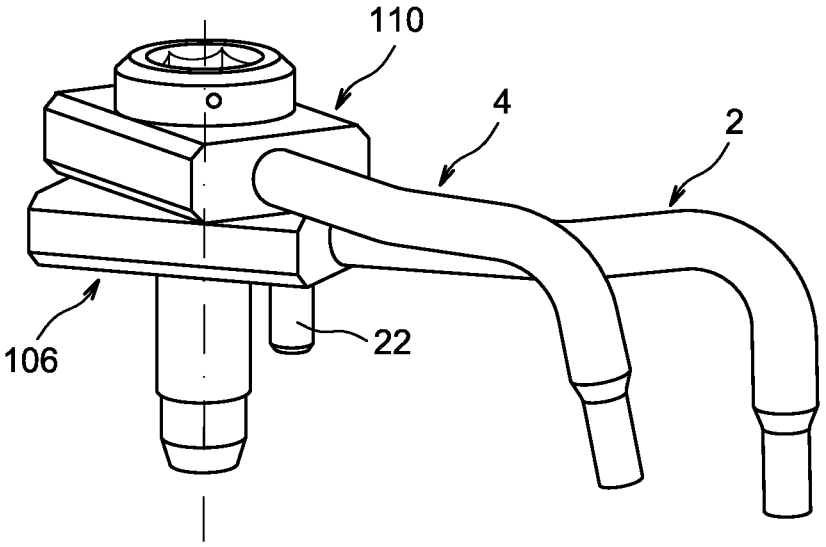
Figure 8:
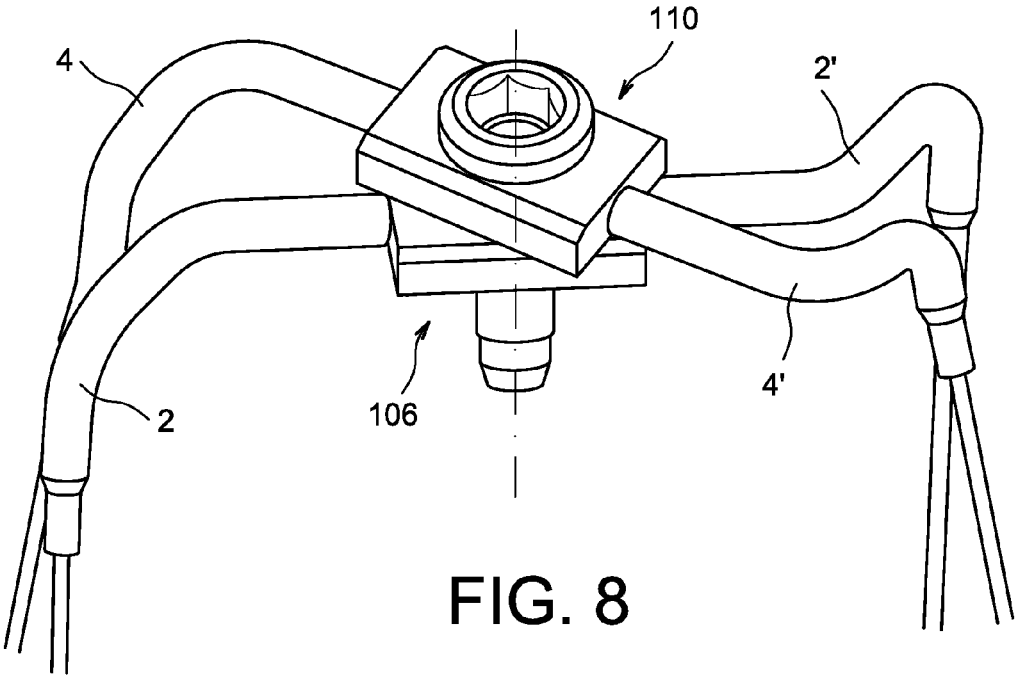
Figure 9:
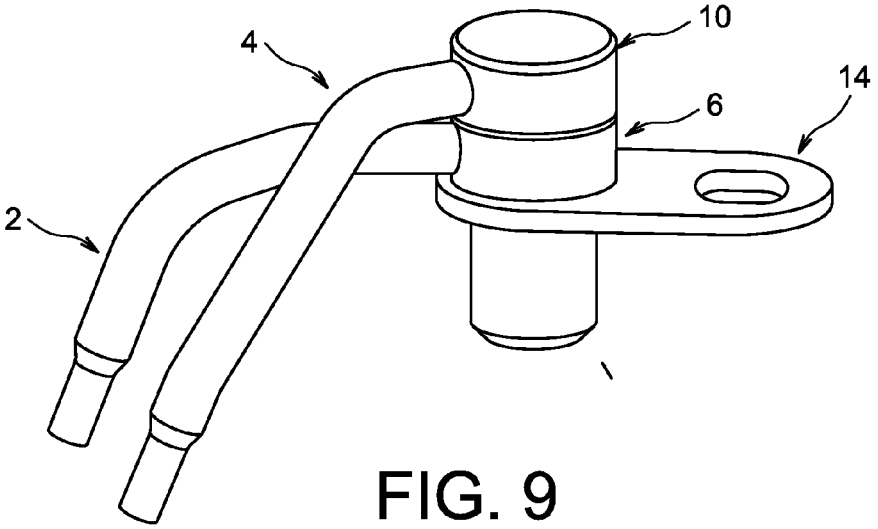
Figure 10:
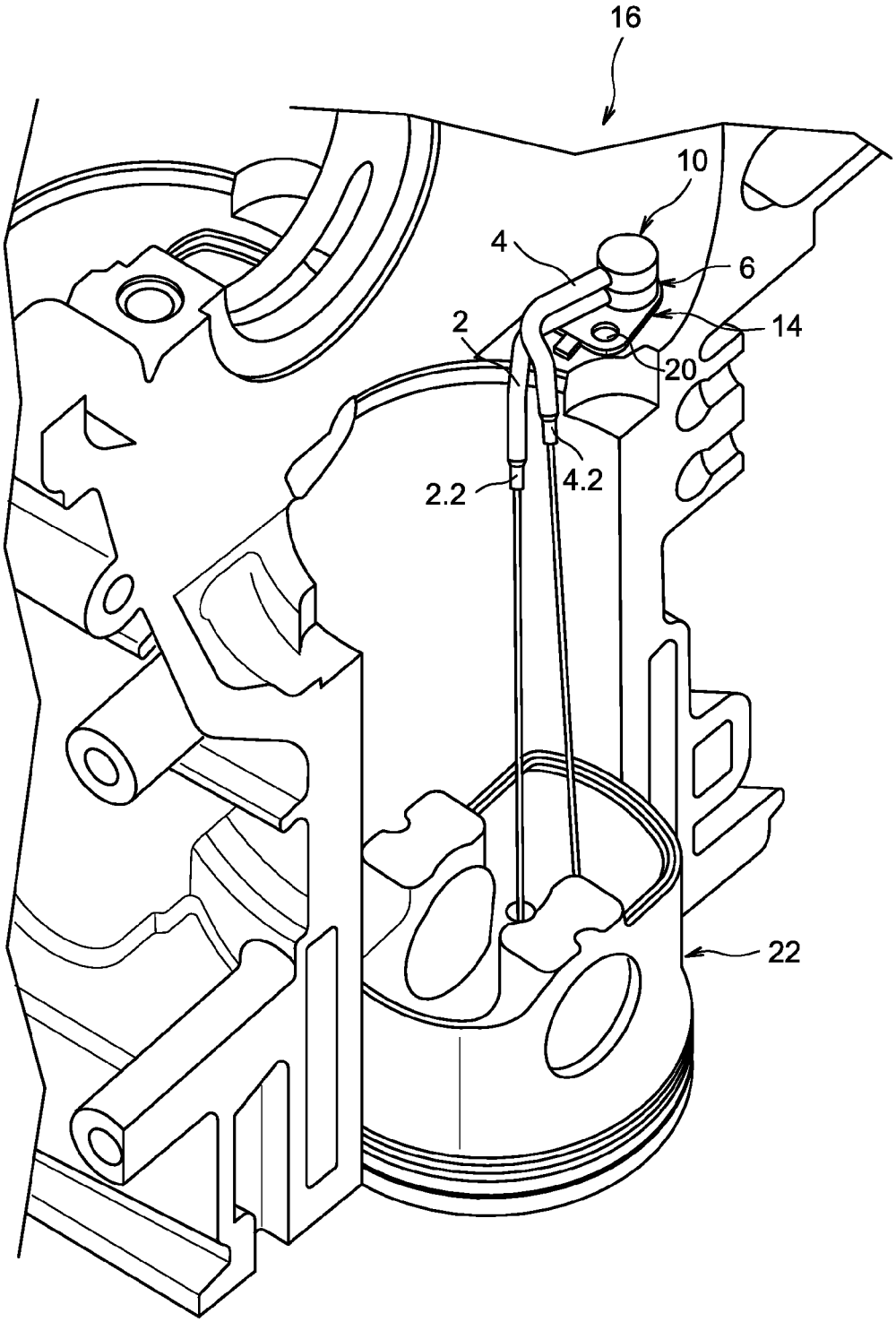

The present invention will be better understood using the description which follows and the appended illustrations, in which:

FIG. 1 is a perspective view of a spray nozzle with two separate tubes of the state of the art, FIG. 2 is a perspective view of a cooling device with two separate tubes according to an example embodiment of the present invention, FIG. 3 is an exploded view of the cooling device of FIG. 2, FIG. 4 is a perspective view of another example embodiment of a cooling device according to the present invention, FIG. 5 is a perspective view of an example embodiment of a cooling device according to the present invention capable of providing four cooling jets, FIG. 6 is a perspective view of a variant embodiment of the device of FIG. 2, where the means of attachment to the engine block comprise orientation means, FIG. 7 is a perspective view of a variant embodiment of the device of FIG. 2, FIG. 8 is a perspective view of a variant embodiment of the device of FIG. 5, FIG. 9 is a perspective view of a variant embodiment of the device of FIG. 2, in which the end of one of the tubes is bent, and the bend attached in one of the feed bodies, FIG. 10 is a partial perspective view of a cooling device of FIG. 2 installed in an engine block.

DETAILED DESCRIPTION OF PARTICULAR EMBODIMENTS

In FIG. 2 an example embodiment of a cooling device can be seen with two separate tubes according to the present invention, having a first tube 2 and a second tube 4, the tubes being superposed.

The cooling device comprises a first subassembly E1 and a second subassembly E2 which are securely attached to one another.

First subassembly E1 comprises first tube 2 and a feed body 6. First tube 2 comprises a first end 2.1 by which it is attached to feed body 6, and a second free end 2.2 intended for the outlet of the cooling fluid jet and for its orientation in the direction of the piston.

Feed body 6 is hollow and comprises a first longitudinal end 6.1 intended to be connected to a cooling fluid feed circuit of the internal combustion engine, a second longitudinal end 6.2 configured to feed second subassembly E2 with cooling fluid, and a lateral aperture 8 for connection to first end 2.1 of first tube 2. Body 6 thus causes the cooling fluid to flow from first longitudinal end 6.1 to end 2.2 of first tube 2 via lateral aperture 8 and towards second longitudinal end 6.2.

The second subassembly comprises second tube 4 and a second feed body 10.

Second feed body 10 comprises a longitudinal end 10.1 connected to second longitudinal end 6.1 of first feed body 6. Second feed body 10 also comprises a lateral aperture 11, to which second tube 4 is connected by a first end 4.1. Second tube 4 also comprises a second end 4.2 through which the cooling fluid jet is evacuated and directed towards a piston.

Feed body 10 is separate from feed body 6 and is securely attached to it. In the represented example feed body 10 comprises a connecting sleeve projecting from first longitudinal end 10.1 of the second feed body fitted into second longitudinal end 6.2 of first feed body 6. In the represented example first feed body 6 has the shape of a cylinder of axis X1, and second feed body 10 has the shape of a cylinder of axis X2. Feed bodies 6, 10 are superposed on one another, and longitudinal axes X1, X2 are coaxial.

In the example of FIGS. 2 and 3 the feed bodies are superposed and securely attached by brazing.

In FIG. 3 an exploded view of the device of FIG. 2 can be seen, in which feed bodies 6 and 10 are separate.

For example, tubes 2 and 4 are attached to feed bodies 6, 10 respectively, for example by brazing.

The method of manufacture of the cooling device according to the invention will now be described.

In a first step, each subassembly E1, E2 is manufactured separately, the first tube is attached securely to first feed body 6 by its longitudinal end 2.1, for example by brazing, and second tube 4 is securely attached to second feed body 10 by its longitudinal end 4.1, for example by brazing. At the end of this step the tubes are generally straight.

In a subsequent step the tubes are deformed to give them a desired orientation relative to their feed body. In the represented example only a portion of the length of the tube located at the free end of the tube is deformed, for example by bending, to orientate it in a given direction, which will be the direction of the jet. In this example it is not the entire length of the tube which is deformed.

As a variant, it could be envisaged to deform the tube from its end connected to the feed body, as represented in FIG. 9, which will be described below.

Tubes 2 and 4 are deformed before assembly and secure attachment of the two subassemblies E1, E2. The step of orientation of the tubes is thus simplified, since the equipment can be positioned freely without being hindered by the presence of another tube.

In a subsequent step, when first 2 and second 4 tubes have the desired orientation, the two feed bodies 6, 10 are securely attached to one another in sealed fashion. For example, the two bodies are securely attached by brazing.

As a variant, assembly by insertion fitting and brazing could be envisaged, for example second feed body 10 is fitted into first feed body 6, and this is then followed by brazing. As a variant, insertion fitting only may be sufficient. Indeed, for a minimal 15 Bar feed pressure, assembly by insertion fitting may be accomplished such that a seal is preserved.

Orientation means may preferentially be comprised between the two subassemblies E1, E2, such as an orientation key form, or an orientation pin.

After the two subassemblies are securely attached there may be an additional step of bending of the free ends of the tubes, to adjust their orientation. It will however be understood that most of the deformation of the tubes to determine their orientation is accomplished before the two subassemblies are assembled.

In FIG. 4 another example embodiment of a cooling device according to the invention can be seen. In this example embodiment second feed body 10 is fitted into first feed body 6. The insertion fitting is sealed by means of a valved-bolt assembly 12, screwed by a second longitudinal element 10.2 of second feed body 10 into first feed body 6. In the represented example an end 12.2 of valved-bolt assembly 12 protrudes from feed body 6 and oil is fed in through the valved-bolt assembly.

As can be seen in FIGS. 2, 3 and 4, the cooling device may be fitted with means 14 for attachment to engine block 16. In FIGS. 2, 3 and 4 attachment means 14 are, in the represented example, formed by a securing plate fitted with an assembly aperture 18 in which the cooling device, and more specifically first feed body 6, is installed. Securing plate 14 is also fitted with one or more apertures 20 by which it can be assembled, for example by screwing, on to the housing of engine 16 (FIG. 10).

In FIG. 6 plate 114 is fitted with a protruding pin 22 which must cooperate with a recess in the engine block to orientate the cooling device relative to the engine block. The cooling device is attached to the engine block by means of valved-bolt assembly 12. As a variant, it may be envisaged for this plate to comprise, in addition to the orientation pin, one or more apertures for attachment to the engine block, where the valved-bolt assembly then is not used for attaching the cooling device to the engine block.

In FIG. 7 a variant embodiment of the device of FIG. 4 can be seen in which feed bodies 106, 110 are parallelepipedic in shape, and where the two feed bodies 106, 110 are at least partly in contact through a surface bearing. In FIG. 7 feed body 106 directly comprises an orientation pin 22 intended to cooperate with the engine block. The two bodies are assembled by means of a valved-bolt assembly 12. In this example embodiment valved-bolt assembly 12 attaches the cooling device to the engine block. Other assembly methods may be used, such as brazing. As a variant, attachment means, such as a securing plate 14, may be used to attach the cooling device to the engine block.

Orientation means may advantageously be comprised between the two feed bodies 106, 110, such as those described in relation with FIGS. 2 and 3.

It will be understood that every other means of attachment of the cooling device to the engine block may be used.

In FIG. 5 an example embodiment of a cooling device able to produce four jets of cooling fluid in four different directions can be seen.

This device is produced in a similar manner to the one described above for the example embodiments of the devices of FIGS. 2 to 4. During the manufacture of each of the subassemblies each of feed bodies 6, 10 comprises two lateral apertures for evacuating the cooling fluid, to which a tube 2, 2', 4, 4' is attached. In the represented example each subassembly comprises two diametrically opposite tubes 2, 2', 4, 4' and pairs of tubes 2, 2', 4, 4' are superposed. However, it could be envisaged for tubes 2, 2', 4, 4' of each subassembly not to be diametrically opposite, and to form an angle of less than 180° between one another.

In FIG. 8 a variant of the cooling device of FIG. 5 can be seen, in which both feed bodies 106, 110 are parallelepipedic in shape. Orientation means are advantageously comprised between the two feed bodies, and orientation means between the cooling device and the engine block are also advantageously comprised, for example in the form of a pin protruding from feed unit 110, intended to cooperate with the engine block.

In FIG. 9 a variant embodiment can be seen in which one of the tubes 4 is orientated by additional bending of its end installed in second feed body 10. Such bending could take place on the tube installed on feed body 6. Such bending could also take place on one or more tubes of the devices of FIG. 7 or 8.

It could also be envisaged not to have the tubes of both subassemblies contained roughly in the same vertical plane, but to have them contained in two separate planes.

In FIG. 10 the cooling device of FIG. 2 installed on an engine block 16 can be seen, producing two jets directed towards the base of a piston 22 of the internal combustion engine. The cooling device is attached to engine block 16 by means of a securing plate 14. The compactness of this cooling device will then be appreciated, which makes it particularly suitable for use in an engine block of a recreational motor vehicle or a private car and any vehicle having a lateral space allowing access to be gained to the piston skirt which is of small dimensions.

The cooling device can also comprise means to inhibit the flow of the cooling fluid until the pressure of the cooling fluid exceeds a determined threshold value. These means are formed for example by ball valves or piston valves. Such means are installed, for example, in the first feed body, and by this means control the feed of both tubes 2, 4 simultaneously.

Using the present invention cooling devices can be inserted in small spaces of the motor vehicle engines, whilst proximity with the rotating elements is ensured. Indeed, in very compact cooling devices they can be positioned as close as possible to the rotating elements which it is desired to cool. In addition, due to its manufacturing method, great flexibility can be obtained in terms of the targeting angles of each of the jets, and the jets can also be made very accurate.

The tubes of a cooling system may be convergent, divergent or intersecting. They may also be used to cool one piston, or several pistons. It may also be envisaged for the cooling device to have more than two tubes, for example three, where these all point towards the same piston.

The cooling device may also comprise more than two subassemblies, for example three or more. If there are three subassemblies the second feed body then roughly has the shape of the first feed body, and the third feed body has that of the second feed body of the device of FIG. 2 or that of FIG. 4, depending on the method by which the subassemblies are assembled. Assembly may then be accomplished for example by brazing between the first and second subassembly and by using a valved-bolt assembly between the second and third subassemblies, or alternatively only by brazing, between all the subassemblies or only by one valved-bolt assembly.

The invention claimed is:

1. A device for cooling a piston of an internal combustion engine of a motor vehicle comprising:

a cooling fluid feed system configured to provide fluid to the device, a first subassembly comprising a first feed body with a first longitudinal axis, a feed aperture configured to connect to the cooling fluid feed system, and a first tube, a first end of the first tube being connected to the first feed body and a second end of the first tube being a free end which forms a first evacuation end for evacuating the fluid from the cooling fluid feed system towards one or more areas for cooling, the first tube extending laterally, to protrude radially outward from and relative to the first longitudinal axis of the first feed body, a second subassembly comprising a second feed body with a second longitudinal axis, the second subassembly being connected to the first subassembly, the second subassembly further comprising a second tube, a first end of the second tube being connected to the second feed body and a second end of the second tube being a free end which forms a second evacuation end for evacuating the fluid from the cooling fluid feed system through the first subassembly towards the one or more areas for cooling, the second tube extending laterally, to protrude radially outward from and relative to the second longitudinal axis of the second feed body, wherein the first subassembly and the second subassembly are superposed on one another, and wherein the first feed body and the second feed body are securely attached to one another in sealed fashion, the first longitudinal axis and the second longitudinal axis being coaxial.

2. The device according to claim 1, wherein the first subassembly and the second subassembly are securely attached together by brazing.

3. The device according to claim 1, wherein the first subassembly and the second subassembly are securely attached together by a valved-bolt assembly.

4. The device according to claims 3, wherein the fastener comprises a securing plate attached to the first feed body, the securing plate being configured to be attached to the engine block by the valved-bolt assembly.

5. The device according to claim 1, wherein the second subassembly is configured to be fed with the fluid through the first feed body.

6. The device according to claim 1, wherein each of the first subassembly and the second subassembly has two tubes.

7. The device according to claim 1 further comprising a controller for controlling a flow of the fluid.

8. The device according to claim 1 further comprising a fastener for attaching the device to an engine block.

9. The device according to claim 8, wherein the fastener comprises a securing plate attached to the first feed body, the securing plate being configured to be attached to the engine block.

10. The device according to claim 1 further comprising an orientation device for orientating the device relative to an engine block.

11. The device according to claim 10, wherein the orientation device is supported directly by the first feed body and by a plate which is securely attached to the first feed body.

12. The device according to claim 10, wherein the orientation device comprises a pin configured to penetrate into an aperture in the engine block.

13. A manufacturing method for manufacture of the cooling device according to claim 1, comprising the steps of:

constructing the first subassembly comprising the first feed body fitted with the feed aperture configured to connect to the cooling fluid feed system, and constructing the first tube, said first tube being connected to the first feed body, constructing the second subassembly comprising the second feed body configured to connect to the first sub assembly, and constructing the second tube, said second tube being connected to the second feed body, shaping the first tube to have a first given orientation, shaping the second tube to have a second given orientation, assembling and attaching the first subassembly and the second subassembly together.

14. The manufacturing method according to claim 13, wherein the first tube and the second tube are shaped to respectively have the first given orientation and the second given orientation before the step of assembling and attaching the first subassembly and the second subassembly together.

15. The manufacturing method according to claim 13, further comprising the step of shaping at least one of the second end of the first tube and the second end of the second tube after the step of assembling and attaching the first subassembly and the second subassembly together.

16. The device according to claim 1, wherein the first feed body comprises a first external surface from which the first tube extends, and wherein the second feed body comprises a second external surface from which the second tube extends.

17. The device according to claim 1, wherein the first tube is configured such that the fluid evacuating the first evacuation end is directed towards the one or more areas for cooling, and wherein the second tube is configured such that the fluid evacuating the second evacuation end is directed towards the one or more areas for cooling.

18. An internal combustion engine of a motor vehicle comprising;

an engine block, pistons that can slide in said engine block, and a device for cooling at least one of the pistons, the device comprising a cooling fluid feed system configured to provide fluid to the device, said device comprising a first subassembly and a second subassembly superposed on one another, the first subassembly comprising a first feed body with a first longitudinal axis, a feed aperture configured to connect to the cooling feed supply system, a first tube, a first end of the first tube being connected to the first feed body and a second end of the first tube being a free end which forms a first evacuation end for evacuating the fluid from the cooling fluid feed system towards one or more areas for cooling, the first tube extending laterally, to protrude radially outward from and relative to the first longitudinal axis of the first feed body, the second subassembly comprising a second feed body with a second longitudinal axis, the second subassembly being connected to first sub assembly, the second subassembly further comprising a second tube, a first end of the second tube being connected to the second feed body and a second end of the second tube being a free end which forms a second evacuation end for evacuating the fluid from the cooling fluid feed system through the first subassembly towards the one or more areas for cooling, the second tube extending laterally, to protrude radially outward from and relative to the second longitudinal axis of the second feed body, the first feed body and the second feed body being securely attached to one another in sealed fashion, wherein the first longitudinal axis and the second longitudinal axis are coaxial, and wherein at least one of the first tube and the second tube of said device points towards the at least one of the pistons.

19. The device according to claim 18, wherein the first feed body comprises a first external surface from which the first tube extends, and wherein the second feed body comprises a second external surface from which the second tube extends.

20. The device according to claim 18, wherein the first tube is configured such that the fluid evacuating the first evacuation end is directed towards the one or more areas for cooling, and wherein the second tube is configured such that the fluid evacuating the second evacuation end is directed towards the one or more areas for cooling.

* * * * *